US011342683B2

(12) United States Patent
Smith et al.

(10) Patent No.: US 11,342,683 B2
(45) Date of Patent: May 24, 2022

(54) MICROWAVE/MILLIMETER-WAVE WAVEGUIDE TO CIRCUIT BOARD CONNECTOR

(71) Applicant: Cubic Corporation, San Diego, CA (US)

(72) Inventors: Timothy Smith, Durham, NC (US); Jean-Marc Rollin, Chapel Hill, NC (US); Jared Jordan, Raleigh, NC (US); Brian Kerrigan, Cary, NC (US); William Stacy, Blacksburg, VA (US)

(73) Assignee: Cubic Corporation, San Diego, CA (US)

( * ) Notice: Subject to any disclaimer, the term of this patent is extended or adjusted under 35 U.S.C. 154(b) by 313 days.

(21) Appl. No.: 16/369,701

(22) Filed: Mar. 29, 2019

(65) Prior Publication Data

US 2019/0334249 A1 Oct. 31, 2019

Related U.S. Application Data

(60) Provisional application No. 62/662,382, filed on Apr. 25, 2018.

(51) Int. Cl.

| | |
|---|---|
| ***H01Q 21/00*** | (2006.01) |
| ***H01R 12/72*** | (2011.01) |
| ***H01R 12/70*** | (2011.01) |
| ***H01R 12/55*** | (2011.01) |
| ***H01R 24/50*** | (2011.01) |
| *H01R 103/00* | (2006.01) |

(52) U.S. Cl.

CPC ..... *H01Q 21/0037* (2013.01); *H01R 12/55* (2013.01); *H01R 12/7076* (2013.01); *H01R 12/722* (2013.01); *H01R 24/50* (2013.01); *H01R 2103/00* (2013.01); *H01R 2201/02* (2013.01)

(58) Field of Classification Search

CPC ..... H01Q 21/0037; H01R 12/55; H01R 12/7076; H01R 12/722; H01R 4/50; H01R 24/50; H01R 2103/00; H01R 2201/02

See application file for complete search history.

(56) References Cited

U.S. PATENT DOCUMENTS

| | | | |
|---|---|---|---|
| 3,157,847 | A | 11/1964 | Williams |
| 3,618,105 | A | 11/1971 | Bruene |
| 3,820,041 | A | 6/1974 | Gewartowski |
| 4,218,685 | A | 8/1980 | Frosch |

(Continued)

FOREIGN PATENT DOCUMENTS

| | | |
|---|---|---|
| JP | 2008283012 | 11/2008 |
| JP | 2008307737 | 12/2008 |

(Continued)

OTHER PUBLICATIONS

Ghannoum, H. et al. "Probe Fed Stacked Patch Antenna for UWB Sectoral Applications," IEEE International Conference on Ultra-Wideband 2005. pp. 97-102.

(Continued)

*Primary Examiner* — Graham P Smith

(74) *Attorney, Agent, or Firm* — Kilpatrick Townsend & Stockton LLP

(57) ABSTRACT

Circuit board connector that provides electrical connection between conductive traces in a printed circuit board and microwave/millimeter-wave components.

27 Claims, 4 Drawing Sheets

(56) References Cited

U.S. PATENT DOCUMENTS

| | | | | |
|---|---|---|---|---|
| 4,647,942 | A | 3/1987 | Counselman, III | |
| 4,677,393 | A | 6/1987 | Sharma | |
| 4,994,817 | A | 2/1991 | Munson | |
| 5,405,267 | A | 4/1995 | Koegel | |
| 5,557,291 | A | 9/1996 | Chu | |
| 6,101,705 | A | 8/2000 | Wolfson | |
| 6,238,218 | B1 | 5/2001 | Baffert | |
| 6,317,099 | B1 | 11/2001 | Zimmerman | |
| 6,323,809 | B1 | 11/2001 | Maloney | |
| 6,356,241 | B1 | 3/2002 | Jaeger | |
| 6,512,487 | B1 | 1/2003 | Taylor | |
| 6,842,158 | B2 | 1/2005 | Jo | |
| 7,079,079 | B2 | 7/2006 | Jo | |
| 7,109,936 | B2 | 9/2006 | Mizoguchi | |
| 7,463,210 | B2 | 12/2008 | Rawnick | |
| 7,764,236 | B2 | 7/2010 | Hill | |
| 7,889,147 | B2 | 2/2011 | Tam | |
| 7,948,335 | B2 * | 5/2011 | Sherrer | H01P 3/00 333/244 |
| 8,325,093 | B2 | 12/2012 | Holland | |
| 9,130,262 | B2 | 9/2015 | Park | |
| 9,306,254 | B1 | 4/2016 | Hovey | |
| 10,008,779 | B2 | 6/2018 | Boryssenko | |
| 2003/0231134 | A1 | 12/2003 | Yarasi | |
| 2004/0119557 | A1 | 6/2004 | Barnes | |
| 2004/0263410 | A1 | 12/2004 | Teillet | |
| 2005/0013977 | A1 | 1/2005 | Wong | |
| 2005/0040994 | A1 | 2/2005 | Mazoki | |
| 2005/0116862 | A1 | 6/2005 | du Toit | |
| 2006/0232489 | A1 | 10/2006 | Bisiules | |
| 2007/0126651 | A1 | 6/2007 | Snyder | |
| 2008/0074339 | A1 | 3/2008 | Lee | |
| 2008/0079644 | A1 | 4/2008 | Cheng | |
| 2009/0051619 | A1 | 2/2009 | Hook | |
| 2009/0284419 | A1 | 11/2009 | Kim | |
| 2010/0007572 | A1 | 1/2010 | Jones | |
| 2011/0025574 | A1 | 2/2011 | Tiezzi | |
| 2011/0057852 | A1 | 3/2011 | Holland | |
| 2012/0146869 | A1 | 6/2012 | Holland | |
| 2013/0002501 | A1 | 1/2013 | Li | |
| 2013/0169505 | A1 | 7/2013 | Shmuel | |
| 2014/0103423 | A1 | 4/2014 | Ohlsson | |
| 2014/0218131 | A1 * | 8/2014 | Sherrer | H01P 5/183 333/136 |
| 2014/0354500 | A1 | 12/2014 | Tayama | |
| 2015/0162665 | A1 | 6/2015 | Boryssenko | |
| 2016/0268695 | A1 | 9/2016 | Zavrel, Jr. | |
| 2016/0294035 | A1 | 10/2016 | Rollin | |
| 2016/0370568 | A1 | 12/2016 | Toussaint | |
| 2017/0025767 | A1 | 1/2017 | Elsallal | |
| 2017/0170592 | A1 | 6/2017 | Sherrer | |
| 2017/0256859 | A1 | 9/2017 | Boryssenko | |
| 2018/0323510 | A1 | 11/2018 | Boryssenko | |

FOREIGN PATENT DOCUMENTS

| | | |
|---|---|---|
| WO | 2007076105 | 7/2007 |
| WO | 2014011675 | 1/2014 |

OTHER PUBLICATIONS

A. Boryssenko, J. Arroyo, R. Reid, M.S. Heimbeck, "Substrate free G-band Vivaldi antenna array design, fabrication and testing" 2014 IEEE International Conference on Infrared, Millimeter, and Terahertz Waves, Tucson, Sep. 2014.

B. Cannon, K. Vanhille, "Microfabricated Dual-Polarized, W-band Antenna Architecture for Scalable Line Array Feed," 2015 IEEE Antenna and Propagation Symposium, Vancouver, Canada, Jul. 2015.

D. Filipovic, G. Potvin, D. Fontaine, C. Nichols, Z. Popovic, S. Rondineau, M. Lukic, K. Vanhille, Y. Saito, D. Sherrer, W. Wilkins, E. Daniels, E. Adler, and J. Evans, "Integrated micro-coaxial Ka-band antenna and array," GomacTech 2007 Conference, Mar. 2007.

E. Cullens, L. Ranzani, E. Grossman, Z. Popovic, "G-Band Frequency Steering Antenna Array Design and Measurements," Proceedings of the XXXth URSI General Assembly, Istanbul, Turkey, Aug. 2011.

Gao, S. et al. "A Broad-Band Dual-Polarized Microstrip Patch AntennaWith Aperture Coupling," IEEE Transactions on Antennas And Propagation, vol. 51, No. 4, Apr. 2003. pp. 898-900.

Gao, S.C., et al., Dual-polarised Wideband Microstrip Antenna, Electronic Letters, Aug. 30, 2001, vol. 37, No. 18, pp. 1106-1107.

Guo, Y.X. et al. "L-probe proximity-fed short-circuited patch antennas," Electronics Letters, vol. 35 No. 24, Nov. 25, 1999. pp. 2069-2070.

H. Zhou, N. A. Sutton, D. S. Filipovic, "Surface micromachined millimeter-wave log-periodic dipole array antennas," IEEE Trans. Antennas Propag., Oct. 2012, vol. 60, No. 10, pp. 4573-4581.

H. Zhou, N. A. Sutton, D. S. Filipovic, "Wideband W-band patch antenna," 5th European Conference on Antennas and Propagation , Rome, Italy, Apr. 2011, pp. 1518-1521.

Holzheimer, et al., Performance Enhancements with Applications of the Coaxial Cavity Antenna, pp. 171-193.

Hsu, Wen-Hsiu et al. "Broadband Aperture-Coupled Shorted-Patch Antenna," Microwave and Optical Technology Letters, vol. 28, No. 5, Mar. 5, 2001. pp. 306-307.

J. M. Oliver, J.-M. Rollin, K. Vanhille, S. Raman, "A W-band micromachined 3-D cavity-backed patch antenna array with integrated diode detector," IEEE Trans. Microwave Theory Tech., Feb. 2012, vol. 60, No. 2, pp. 284-292.

J. M. Oliver, P. E. Ralston, E. Cullens, L. M. Ranzani, S. Raman, K. Vanhille, "A W-band Micro-coaxial Passive Monopulse Comparator Network with Integrated Cavity-Backed Patch Antenna Array," 2011 IEEE MTT-S Int. Microwave, Symp., Baltimore, MD, Jun. 2011.

J. Mruk, Z. Hongyu, M. Uhm, Y. Saito, D. Filipovic, "Wideband mm-Wave Log-Periodic Antennas," 3rd European Conference on Antennas and Propagation, pp. 2284-2287, Mar. 2009.

J. R. Mruk, N. Sutton, D. S. Filipovic, "Micro-coaxial fed 18 to 110 GHz planar log-periodic antennas with RF transitions," IEEE Trans. Antennas Propag., vol. 62, No. 2, Feb. 2014, pp. 968-972.

J.R. Mruk, Y. Saito, K. Kim, M. Radway, D. Filipovic, "A directly fed Ku- to W-band 2-arm Archimedean spiral antenna," Proc. 41st European Microwave Conf., Oct. 2011, pp. 539-542.

K. M. Lambert, F. A. Miranda, R. R. Romanofsky, T. E. Durham, K. J. Vanhille, "Antenna characterization for the Wideband Instrument for Snow Measurements (WISM)," 2015 IEEE Antenna and Propagation Symposium, Vancouver, Canada, Jul. 2015.

K. Vanhille, M. Lukic, S. Rondineau, D. Filipovic, and Z. Popovic, "Integrated micro-coaxial passive components for millimeter-wave antenna front ends," 2007 Antennas, Radar, and Wave Propagation Conference, May 2007.

L. Ranzani, N. Ehsan, Z. Popovic, "G-band frequency-scanned antenna arrays," 2010 IEEE APS-URSI International Symposium, Toronto, Canada, Jul. 2010.

M. Lukic, D. Fontaine, C. Nichols, D. Filipovic, "Surface micromachined Ka-band phased array antenna," Presented at Antenna Applic. Symposium, Monticello, IL, Sep. 2006.

M. Lukic, K. Kim, Y. Lee, Y. Saito, and D. S. Filipovic, "Multiphysics design and performance of a surface micromachined Ka-band cavity backed patch antenna," 2007 SBMO/IEEE Int. Microwave and Optoelectronics Conf., Oct. 2007, pp. 321-324.

M. V. Lukic, and D. S. Filipovic, "Integrated cavity-backed ka-band phased array antenna," Proc. IEEE-APS/URSI Symposium, Jun. 2007, pp. 133-135.

M. V. Lukic, and D. S. Filipovic, "Surface-micromachined dual Ka-band cavity backed patch antenna," IEEE Trans. Antennas Propag., vol. 55, No. 7, pp. 2107-2110, Jul. 2007.

Mruk, J.R., Saito, Y, Kim, K., Radway, M., Filipovic, D.S., "Directly fed millimetre-wave two-arm spiral antenna," Electronics Letters, Nov. 25, 2010, vol. 46 , issue 24, pp. 1585-1587.

N. Chamberlain, M. Sanchez Barbetty, G. Sadowy, E. Long, K. Vanhille, "A dual-polarized metal patch antenna element for phased

(56) References Cited

OTHER PUBLICATIONS array applications," 2014 IEEE Antenna and Propagation Symposium, Memphis, Jul. 2014. pp. 1640-1641.
N. Jastram, D. S. Filipovic, "Parameter study and design of W-band micromachined tapered slot antenna," Proc. IEEE-APS/URSI Symposium, Orlando, FL, Jul. 2013, pp. 434-435.
N. Sutton, D.S. Filipovic, "Design of a K- thru Ka-band modified Butler matrix feed for a 4-arm spiral antenna," 2010 Loughborough Antennas and Propagation Conference, Loughborough, UK, Nov. 2010, pp. 521-524.
N.A. Sutton, D. S. Filipovic, "V-band monolithically integrated four-arm spiral antenna and beamforming network," Proc. IEEE-APS/URSI Symposium, Chicago, IL, Jul. 2012, pp. 1-2.
Nakano, M., et al., "Feed Circuits of Double-Layered Self-Diplexing Antenna for Mobile Satelite Communications", Transactions on Antennas and Propagation, vol. 40, No. 1, Oct. 1992, pp. 1269-1271.
Oliver, J.M. et al., "A3-D micromachined W-band cavity backed patch antenna array with integrated rectacoax transition to wave guide," 2009 Proc. IEEE International Microwave Symposium, Boston, MA 2009.
Sevskiy, S. and Wiesbeck, W., "Air-Filled Stacked-Patch Antenna," ITG-Fachberichte. No. 178, (2003). pp. 53-56.
T. E. Durham, C. Trent, K. Vanhille, K. M. Lambert, F. A. Miranda, "Design of an 8-40 GHz Antenna for the Wideband Instrument for Snow Measurements (WISM)," 2015 IEEE Antenna and Propagation Symposium, Vancouver, Canada, Jul. 2015.
Tim Holzheimer, Ph.D., P .E., The Low Dispersion Coaxial Cavity as an Ultra Wideband Antenna, 2002 IEEE Conference on Ultra Wideband Systems and Technologies, pp. 333-336.
Vallecchi, A. et al. "Dual-Polarized Linear Series-Fed Microstrip ArraysWith Very Low Losses and Cross Polarization," IEEE Antennas And Wireless Propagation Letter, vol. 3, 2004. pp. 123-126.
Y. Saito, J.R. Mruk, J.-M. Rollin, D.S. Filipovic, "X- through Q-band log-periodic antenna with monolithically integrated u-coaxial impedance transformer/feeder," Electronic Letts. Jul. 2009, pp. 775-776.
Y. Saito, M.V. Lukic, D. Fontaine, J.-M. Rollin, D.S. Filipovic, "Monolithically Integrated Corporate-Fed Cavity-Backed Antennas," IEEE Trans. Antennas Propag., vol. 57, No. 9, Sep. 2009, pp. 2583-2590.
Z. Popovic, "Micro-coaxial micro-fabricated feeds for phased array antennas," in IEEE Int. Symp. on Phased Array Systems and Technology, Waltham, MA, Oct. 2010, pp. 1-10. (Invited).
Zurcher, J. "Broadband Patch Antennas," Chapters, 1995. pp. 45-61.
Ben Munk et al.; "A Low-Profile Broadband Phased Array Antenna"; The Ohio State University ElectroScience Laboratory, Dept. of Electrical Engineering; 2003 pp. 448-451.
Woorim Shin, et al. "A 108-114 GHz 4 4 Wafer-Scale Phased Array Transmitter With High-Efficiency On-Chip Antennas"; IEEE Journal of Solid-State Circuits, vol. 48, No. 9, Sep. 2013.
Harold A. Wheeler; "Simple Relations Derived from a Phased-Array Antenna Made of an Infinite Current Sheet"; IEEE Transactions On Antennas Propagation; Jul. 1965; pp. 506-514.
E. G. Magill, et al.; Wide-Angle Impedance Matching of a Planar Array Antenna by a Dielectric Sheet; IEEE Transactions on Antennas Propagation; Jan. 1966; vol. AP-14 No. 1; pp. 49-53.
P. W. Hannan, et al.; Impedance Matching a Phased-Array Antenna Over Wide Scan Angles by Connecting Circuits; Impedance Matching a Phased-Array Antenna; Jan. 1965 pp. 28-34.
James E. Dudgeon, et al.;Microstrip Technology And Its Application to Phased Array Compensation; Jan. 21, 1972; pp. 1-81.
Kerry Speed, et al.; Progress on the 8-40 GHz Wideband Instrument for Snow Measurements(WISM); Harris.com Earth Science Tech nology Forum 2014 Oct. 28-30, 2014 Leesburg, VA; pp. 1-36.
Mark Jones, et al.; A New Approach To Broadband Array Design Using Tightly Coupled Elements; IEEE; 2007; pp. 1-7.
W. M. Qureshi,, et al., Fabrication of a Multi-Octave Phased Array Aperture; 6th EMRS DTC Technical Conference—Edinburgh; 2009; pp. 1-5.
John Forrest McCann, B.S.; On The Design of Large Bandwidth Arrays of Slot Elements With Wide Scan Angle Capabilities; Thesis The Ohio State University; 2006; pp. 1-102.
Tengfei Xia,, et al.; Design of a Tapered Balun for Broadband Arrays With Closely Spaced Elements; IEEE Antennas and Wireless Propagation Letters, vol. 8, 2009; pp. 1291-1294.
Justin A. Kasemodel, et al.; A Miniaturization Technique for Wideband Tightly Coupled Phased Arrays; IEEE; 2009; pp. 1-4.
Elias A. Alwan,, et al.; A Simple Equivalent CircuitModel for Ultrawideband Coupled Arrays; IEEE Antennas and Wireless Propagation Letters, vol. 11, 2012; pp. 117-120.
Nathanael J. Smith; Development of A 180° Hybrid Balun to Feed a Tightly Coupled Dipole X-Band Array; The Ohio State University 2010; pp. 1-52.
Justin A. Kasemodel; Realization of a Planar Low-Profile Broadband Phased Array Antenna; Dissertation, The Ohio State University 2010; pp. 1-120.
Justin A. Kasemodel, et al.; Low-Cost, Planar and Wideband Phased Array with Integrated Balun and Matching Network for Wide-Angle Scanning; IEEE 2010; pp. 2-4.
Erdinc Irci; Low-Profile Wideband Antennas Based on Tightly Coupled Dipole and Patch Elements; Dissertation, The Ohio State University 2011; pp. 1-126.
William F. Moulder; Novel Implementations of Ultrawideband Tightly Coupled Antenna Arrays; Dissertation, The Ohio State University 2012; pp. 1-133.
Ioannis Tzanidis; Ultrawideband Low-Profile Arrays of Tightly Coupled Antenna Elements: Excitation, Termination and Feeding Methods; Dissertation, The Ohio State University 2011; pp. 1-189.
Jonathan Doane; Wideband Low-Prole Antenna Arrays: Fundamental Limits and Practical Implementations; Dissertation, The Ohio State University 2013; pp. 1-265.
Justin A. Kasemodel et al.; Wideband Planar Array With Integrated Feed and Matching Network for Wide-Angle Scanning; IEEE Transactions on Antennas and Propagation, vol. 61, No. 9, Sep. 2013; pp. 4528-4537.
Jonathan P. Doane, et al.; Wideband, Wide Scanning Conformal Arrays with Practical Integrated Feeds; Proceedings of the "2013 International Symposium on Electromagnetic Theory"; pp. 859-862.
Steven S. Holland, et al.; Design and Fabrication of Low-Cost PUMA Arrays; IEEE; 2011; pp. 1976-1979.
Steven S. Holland; Low-Profile, Modular, Ultra-Wideband Phased Arrays; Dissertation, University of Massachusetts; Sep. 2011; pp. 1-327.
John T. Logan, et al.; A Review of Planar Ultrawideband Modular Antenna (PUMA) Arrays; Proceedings of the "2013 International Symposium on Electromagnetic Theory"; 2013; pp. 868-871.
D. Cavallo, et al.; Common-Mode Resonances in Ultra Wide Band Connected Arrays of Dipoles: Measurements from the Demonstrator and Exit Strategy; IEEE; 2009; pp. 435-438.
J. J. Lee, et al.; Performance of a Wideband (3-14 GHz) Dual-pol Array; IEEE; 2004; pp. 551-554.
Jian Bai, et al.; Ultra-wideband Slot-loaded Antipodal Vivaldi Antenna Array; IEEE; 2011; pp. 79-81.
E. Garca I, et al.; Elimination of Scan Impedance Anomalies in Ultra-Wide Band Phased Arrays of Differentially Fed Tapered Slot Antenna Elements; IEEE; 2008; pp. 1-4.
Eloy de Lera Acedo, et al.; Study and Design of a Differentially-Fed Tapered Slot Antenna Array; IEEE Transactions on Antennas And Propagation, vol. 58, No. 1, Jan. 2010; pp. 68-78.
Y. Chen, et al.; A Novel Wideband Antenna Array With Tightly Coupled Octagonal Ring Elements; Progress In Electromagnetics Research, vol. 124, 55-70; 2012.
J. Y. Li; Design of Broadband Compact Size Antenna Comprised of Printed Planar Dipole Pairs; Progress In Electromagnetics Research Letters, vol. 12, 99-109; 2009.
Mats Gustafsson; Broadband array antennas using a self-complementary antenna array and dielectric slabs; CODEN:LUTEDX/(TEAT-7129)/1-8; Dec. 13, 2004.
Terry Richard Vogler; Analysis of the Radiation Mechanisms in and Design of Tightly-Coupled Antenna Arrays; Dissertation, Virginia Polytechnic Institute and State University; Sep. 10, 2010; pp. 1-251.

(56) References Cited

OTHER PUBLICATIONS

S. G. Hay, et al.; Analysis of common-mode effects in a dual-polarized planar connected-array antenna; Radio Science, vol. 43, RS6S04, doi:10.1029/2007RS003798; 2008.
A. Chippendale,, et al.; Chequerboard Phased Array Feed Testing for ASKAP; May 3, 2010; pp. 1-41.
Yan Fei, et al.; A Simple Wideband Dual-Polarized Array With Connected Elements; University of Electronic Science and Technology of China (UESTC); 2013; pp. 1-21.
Fei Yan, et al. ; A Simple Wideband Dual-Polarized Array With Connected Elements; Institute of Applied Physics and Computational Mathematics; 978-1-4673-5317-5/13 2013 IEEE.
Tomasz Michna, et al.; Characterization of an Impulse-Transmitting UWB Antenna Array with Dispersive Feed Network; Characterization of an Impulse-Transmitting UWB; 2008; pp. 59-62. Antenna Array with Dispersive Feed Network.
Martin Wagner, et al.; Multi-B and Polarizat ion-Ver satile Array Antenna for Smart Antenna Applications in Cellular Systems; 2004 EEE MTT-S Digest; pp. 1769-1772.
Jeremie Bourqui, et al.; Balanced Antipodal Vivaldi Antenna With Dielectric Director for Near-Field Microwave Imaging; EEE Transactions on Antennas and Propagation, vol. 58, No. 7; Jul. 2010.
R.N. Simons, et al.; Impedance matching of tapered slot antenna using a dielectric transformer; Electronics Letters Nov. 26, 1998 vol. 34 No. 24.
S. A. Adamu, et al.; Review on Gain and Directivity Enhancement Techniques of Vivaldi Antennas; International Journal of Scientific & Engineering Research, vol. 8, Issue 3, Mar. 2017; ISSN 2229-5518.
S. Livingston, et al.; Evolution of Wide Band Array Designs; 2011; IEEE pp. 1957-1960.
J. J. Lee,W et al.; Wide Band Long Slot Array Antennas; IEEE; 2003; pp. 452-455.
Johnson J. H. Wang; A New Planar Multioctave Broadband Traveling-Wave Beam-Scan Array Antenna; Wang Electro-Opto Corporation; 2007; pp. 1-4.
John Toon; New planar design allows fabrication of ultra-wideband, phased-array antennas; 100-TO-1 Bandwidth @ Winter 2006; pp. 18-19.
Hans Steyskal, et al.; Design of Realistic Phased Array Patch Elements Using a Genetic Algorithm; Air Force Research Laboratory; 2010; pp. 246-252.
Benjamin Riviere, et al.; Ultrawideband Multilayer Printed Antenna Arrays With Wide Scanning Capability; 2015; IEEE; 514-515.
Boryssenko, et al.; A Matlab Based Universal CEM CAD Optimizer; 2012; IEEE International Symposium on Antennas and Propagation; pp. 1-25.
Justin A. Kasemodel, et al.; A Novel Non-Symmetric Tightly Coupled Element For Wideband Phased Array Apertures; Dissertation The Ohio State University; 2010; pp. 1-13.
Markus H. Novak, et al.; Ultra-Wideband Phased Array Antennas for Satellite Communications upto Ku- and Ka-Band; May 2015; pp. 1-6.
Wajih Elsallal, et al.; Charateristics of Decade-bandwidth, Balanced Antipodal Vivaldi Antenna (BAVA) Phased Arrays with Time-Delay Beamformer Systems; IEEE International Symposium on Phased Array Systems and Technology.
Michel Arts, et al.; Broadband Differentially Fed Tapered Slot Antenna Array for Radio Astronomy Applications; 2009; 3rd European Conference on Antennas and Propagation; pp. 1-5.
Yongwei Zhang, et al.; Octagonal Ring Antenna for a Compact Dual-Polarized Aperture Array; IEEE Transactions on Antennas and Propagation, vol. 59, No. 10, Oct. 2011; pp. 3927-3932.
Hisao Iwasaki, et al.; A Circularly Polarized Microstrip ANfENNA Using Singly-Fed Proximity Coupled Feed; Proceedings of ISAP '92, Sapporo, Japan; pp. 797-800.
Hansen, Robert C. Phased array antennas. Vol. 213. John Wiley & Sons, 2009.
Herd, J., and S. Duffy. "Overlapped digital subarray architecture for multiple beam phased array radar." Proceedings of the 5th European Conference on Antennas and Propagation (EUCAP). IEEE, 2011.
L. Ranzani, D. Kuester, K. J. Vanhille, A. Boryssenko, E. Grossman and Z. Popovic, "G-band Micro-fabricated Frequency-steered Arrays with 2deg/GHz Beam Steering," IEEE Transactions on Terahertz Science and Technology, vol. 3, No. 5, Sep. 2013.
Kindt, Rick W, and W. Raymond Pickles. All-Metal Flared-Notch Array Radiator for Ultrawideband Applications. No. NRL/MR/5310-10-9279. Naval Research Lab Washington DC Radar Analysis Branch, 2010.
Doane, Jonathan P., Kubilay Sertel, and John L. Volakis. "A wideband, wide scanning tightly coupled dipole array with integrated balun (TCDA-IB)." IEEE Transactions on Antennas and Propagation 61.9 (2013): 4538-4548.
Moulder, William F., Kubilay Sertel, and John L. Volakis. "Superstrate-enhanced ultrawideband tightly coupled array with resistive FSS." IEEE Transactions on Antennas and Propagation 60.9 (2012): 4166-4172.
Papantonis, Dimitrios K., and John L. Volakis. "Dual-polarization TCDA-IB with substrate loading." 2014 IEEE Antennas and Propagation Society International Symposium (APSURSI). IEEE, 2014.
Herd, J., et al. "Multifunction Phased Array Radar (MPAR) for aircraft and weather surveillance." 2010 IEEE Radar Conference. IEEE, 2010.
J. D. Dyson, "The equiangular spiral antenna," Wright Air Development Center, 1957.
Frank B. Gross; Ultra-wideband antenna arrays—The basics—Part I; Apr. 7, 2011.
The ARRL Atenna Book, by Gerald Hall (Year: 1988).
Office Action dated Nov. 8, 2018 for U.S. Appl. No. 15/373,016 (pp. 1-20).
Notice of Allowance dated May 20, 2019 for U.S. Appl. No. 15/373,016 (pp. 1-9).

* cited by examiner

MICROWAVE/MILLIMETER-WAVE WAVEGUIDE TO CIRCUIT BOARD CONNECTOR

RELATED APPLICATIONS

This application claims the benefit of priority of U.S. Provisional Application No. 62/662,382, filed on Apr. 25, 2018, the entire contents of which application(s) are incorporated herein by reference.

FIELD OF THE INVENTION

The present invention relates generally to circuit board connections, and more particularly but not exclusively to connectors which may be removably attached to microwave/millimeter-wave components, such as antenna arrays or RF modules, while providing electrical connection between the circuit board and the microwave/millimeter-wave systems.

BACKGROUND OF THE INVENTION

Applicant has recognized that there is no convenient way to removably attach a printed circuit board to microwave and millimeter-wave components, and that removable attachment of the printed circuit board, which may include driving electronics for an antenna, can provide advantages in future servicing or upgrading of the microwave/millimeter-wave-circuit board system. Accordingly, it would be an advance in the art to provide structures which allow a printed circuit board to be removably attached to microwave and millimeter-wave components, such as an antenna array. Furthermore, interconnections become increasingly challenging as the number of connections and the operating frequency increases, because the pitch between connections reduces.

SUMMARY OF THE INVENTION

In one of its aspects the present invention may provide a circuit board connector that provides electrical connection between conductive traces in a printed circuit board and microwave/millimeter-wave structures which may include a coaxial waveguide. As such, circuit board connectors of the present invention may provide an electrical transition between the conductive traces of the printed circuit board and one or more coaxial waveguide structures disposed in the connector. The connector (and/or microwave/millimeter-wave structures) may be monolithically fabricated via PolyStrata® multilayer build processing/technology, in which multiple layers of a material, such as a metal, are sequentially deposited to provide a unitary monolithic structure comprised of the sequential layers. Examples of Poly Strata® processing/technology are illustrated in U.S. Pat. Nos. 7,948,335, 7,405,638, 7,148,772, 7,012,489, 7,649,432, 7,656,256, 7,755,174, 7,898,356 and/or U.S. Application Pub. Nos. 2010/0109819, 2011/0210807, 2010/0296252, 2011/0273241, 2011/0123783, 2011/0181376, 2011/0181377, and commonly owned application 62/614,636, each of which is incorporated herein by reference in their entirety (hereinafter the "incorporated PolyStrata® art"). As used herein, the mark "PolyStrata®" is used in conjunction with the structures made by, or methods detailed in, any of the incorporated PolyStrata® art.

The connector of the present invention may be soldered to the circuit board and may be configured to be removably attached to microwave/millimeter-wave structures to permit removable connection between the microwave/millimeter-wave structures and the combined circuit board/connector. (As used herein the terms "removable" and "removably attached" are defined to mean that parts may be reversibly joined and separated, without damage, by application of only a mechanical force; therefore, such terms exclude attachment by non-removable means, such as epoxy, or by means which require more than a mechanical force, such as solder, which required the application of heat.)

Accordingly, in one of its aspects, the present invention may provide a connector configured to provide physical and electrical connection to a circuit board having conductive traces. The connector may include a mounting feature for receiving an edge of the circuit board, and at least one coaxial waveguide disposed within the connector. The waveguide may include a center conductor having a first end, with the first end configured to be electrically connected to a conductive trace of the circuit board. The connector may include a plurality of sequential layers of a metal joined to provide a unitary monolithic structure, and the plurality of layers may be disposed perpendicular to a longitudinal axis of the center conductor. Alternatively, the plurality of layers may be disposed parallel to a longitudinal axis of the center conductor. The at least one coaxial waveguide may include an air spaced coaxial waveguide, and the mounting feature may be a slot.

In a further of its aspects, the present invention may provide an antenna system comprising an antenna array; a connector in accordance with the present invention as described herein, with the center conductor thereof electrically connected to the antenna array; and at least one circuit board disposed in a mounting feature of the connector. The circuit board may be electrically connected to the center conductor of the connector to provide electrical connection between the circuit board and the antenna array. The circuit board may also include electronics for driving the antenna array. The antenna array may be removably attached to the connector, and may include a plurality of sequential layers of a metal joined to provide a unitary monolithic structure. The antenna array may also include a feedthrough electrically connected to the center conductor of the connector. The first end of the center conductor of the connector may be electrically connected to a selected electrical trace of the circuit board, and may be soldered thereto. In addition, the center conductor of the connector may be electrically connected to the antenna array via a conductive elastomer. The at least one waveguide of the connector may include a plurality of waveguides, and the connector may be electrically connected to the antenna array via a grid of conductive elastomer pins, with each pin disposed in electrical connection with a respective center conductor of the plurality of coaxial waveguides.

In yet a further of its aspects the present invention may provide a connectorized circuit board assembly, comprising a connector in accordance with the present invention as described herein, and comprising a circuit board disposed in the mounting feature of the connector. The circuit board may be electrically connected to the center conductor. In the connectorized circuit board assembly, the first end of the center conductor of the connector may be electrically connected to a selected electrical trace of the circuit board. The first end of the center conductor of the connector may be soldered to a selected electrical trace of the circuit board.

The present invention may also provide an antenna system, comprising an antenna array; a stiffener sheet having a conductive feedthrough extending therethrough, the feedthrough disposed in electrical communication with the antenna array; and at least one circuit board having upper and lower opposing planar surfaces and having an edge extending between the opposing planar surfaces. The edge may include a smaller surface area than the surface area of either of the opposing surfaces with a metallization on the edge. The metallization may be electrically connected to the conductive feedthrough of the stiffener sheet to provide electrical connection between the circuit board and the antenna array.

Further, the present invention may provide a method for creating a connector configured to provide physical and electrical connection to a circuit board having conductive traces. The method may include depositing a plurality of layers over a substrate, wherein the layers comprise one or more of conductive, non-conductive and sacrificial materials; patterning the layers of conductive, non-conductive and sacrificial material to define the structure of the connector which includes a mounting feature for receiving an edge of the circuit board, and at least one coaxial waveguide disposed within the connector. The waveguide may include a center conductor having a first end, the first end configured to be electrically connected to a conductive trace of the circuit board. The method may further include removing the sacrificial material to provide the connector. The plurality of layers may be disposed parallel to a longitudinal axis of the center conductor or may be disposed perpendicular to a longitudinal axis of the center conductor. The at least one coaxial waveguide may include an air spaced coaxial waveguide. The method may be performed by techniques adapted from those disclosed in the incorporated PolyStrata® art.

BRIEF DESCRIPTION OF THE DRAWINGS

The foregoing summary and the following detailed description of exemplary embodiments of the present invention may be further understood when read in conjunction with the appended drawings, in which.

DETAILED DESCRIPTION OF THE INVENTION

Figure 1:
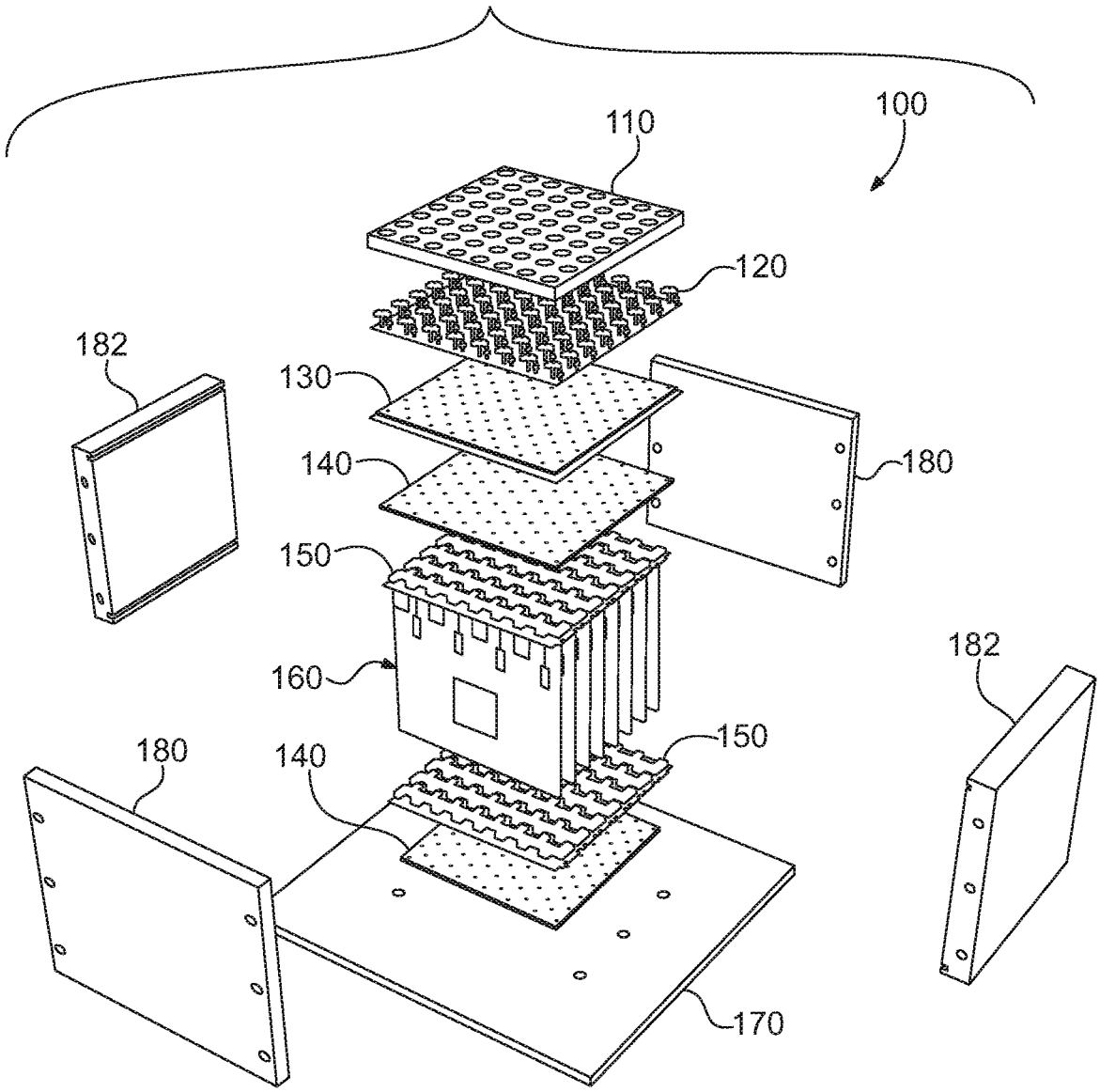
FIG. 1 schematically illustrates an exploded isometric view of an exemplary configuration of a microwave/millimeter-wave component to circuit board connector in accordance with the present invention in which antenna array elements are electrically connected with driving electronics provided on printed circuit boards.
Figure 2:
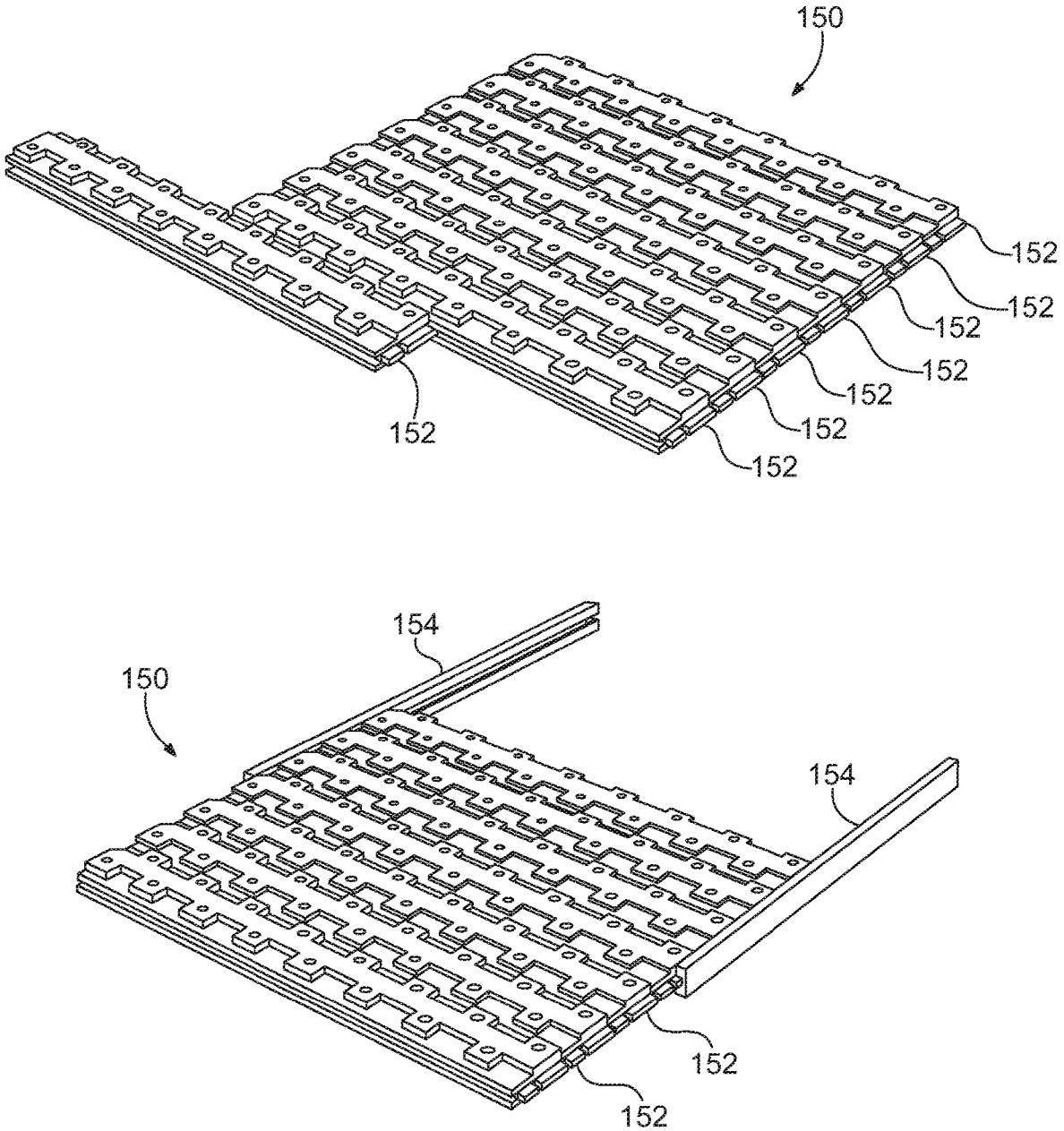
FIG. 2 schematically illustrates isometric views, partially assembled and assembled, of the connector of FIG. 1.
Figure 3:
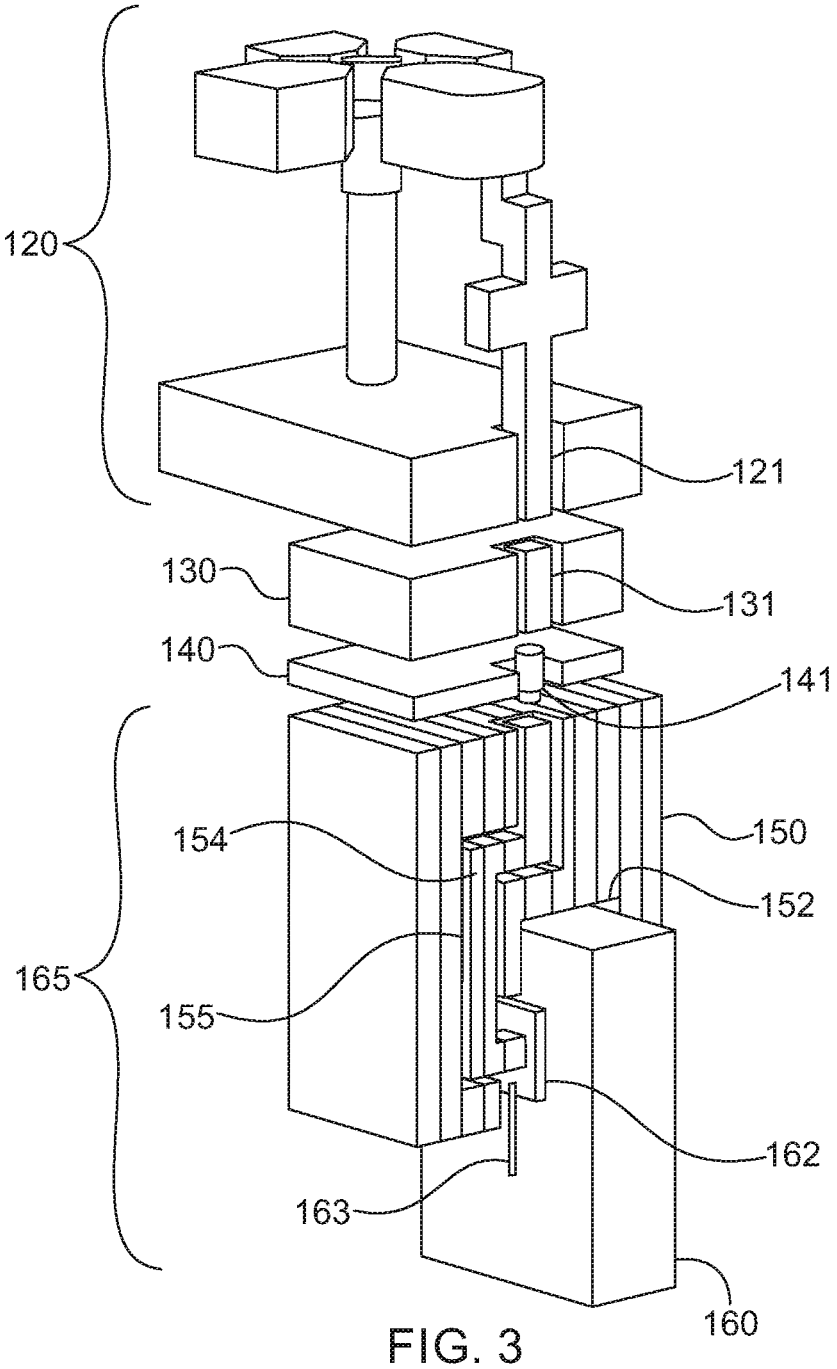
FIG. 3 schematically illustrates a fragmentary view of the structure of FIG. 1.

Referring now to the figures, wherein like elements are numbered alike throughout, FIGS. 1-3 schematically illustrate an exemplary system, in this case an antenna array system 100, which depicts various aspects of connectors 150 in accordance with the present invention. Specifically, among the features illustrated are how connectors 150 of the present invention may be fixedly attached to circuit boards 160, such as by solder, and removably attached to microwave/millimeter-wave components, such as an antenna array 120 with aperture array 110.

More specifically, the connector 150 may include a slot 152 into which an edge of the printed circuit board 160 may be inserted, FIG. 3. The connector 150 may include a coaxial waveguide 155 having a center conductor 154. The coaxial waveguide 155 may also be termed a 3D coaxial waveguide 155, due to its three-dimensional routing through the body of the connector 150. As such, the center conductor 154 may be ground shielded on all four sides in the case of rectacoax and may provide optimum isolation between two adjacent signal lines (each surrounded by metal shielding). The center conductor 154 may have other shapes than rectangular. A selected end of the center conductor 154 proximate the slot 152 may be soldered to a solder pad 162 on the circuit board 160, where the solder pad 162 is electrically connected to a conductive trace 163 of the circuit board 160. Thus, the connector 150 soldered onto the circuit board 160 may provide a connectorized circuit board assembly 165. Other suitable means for fixedly attaching the connector 150 to the circuit board 160 may be provided, such as a conductive epoxy, for example. The circuit board 160 may include circuitry for controlling the antenna array 120.

As to the removable connection between the connector 150 and the antenna array 120, a conductive elastomer pin 141, such as one provided in a land grid array, LGA 140, may be provided at the end of the connector 150 proximate the antenna array 120. The LGA 140 may include multiple forms of "separable" (i.e., removable as defined herein) interconnect between the stiffener 130 and/or the connector 150, including but not limited to: elastomer interconnects, metal spring interconnects, fuzz buttons, and/or diamond particle interconnect. In addition, the LGA 140 may include a hybrid of a separable interconnect and non-separable interconnect, such as solder and conductive epoxy. For example, the LGA 140 may include a separable compressive interconnection, such as a conductive elastomer, on one side of the LGA 140 and a ball grid array of solder bumps on the opposite side. Thus, for such a configuration the LGA 140 may separate from the remaining structure, but only on one side.

The conductive elastomer pin 141 may be disposed in registration and electrical contact with the center conductor 154 of the connector 150. The conductive elastomer pin 141 may be electrically connected to a corresponding conductive feedthrough 121 of the antenna array 120. Optionally, a stiffener 130 may be provided between the LGA 140 and the antenna array 120 to provide additional stiffness to the antenna array 120, if required. The stiffener 130 may be provided in the form of a metal sheet having a conductive feedthrough 131 extending therethrough. The conductive feedthrough 131 of the stiffener 130 may be electrically connected to the feedthrough 121 of the antenna array 120 as well as to the conductive elastomer pin 141, thus completing electrical connection between the solder pad 162 of the circuit board 160 and the antenna array 120.

As further illustrated in FIG. 1, a plurality of connectors 150 and a plurality of circuit boards 160 may be electrically connected to one another to drive the entire antenna array 120. More specifically, in the context of the antenna array system 100, a system circuit board 170 may be provided which includes circuitry for communication with the antenna array 120 as well as other optional components for controlling a broader system of which the antenna array system 100 is but one component. The system circuit board 170 may be connected to the circuit boards 160 via an array of connectors 150 via an LGA 140, in a manner similar to that described above with regard to FIG. 3. To permit a plurality of circuit boards 160 to be electrically connected to an array of antenna elements 120, each connector element 150 as illustrated in FIG. 3, may be provided as a grid of elements as illustrated in FIGS. 1, 2. In particular, with reference to FIG. 2, the array of connectors 150 may be assembled from a plurality of individual one-dimensional connector strips 152, each strip 152 including a plurality of connector elements 150. The connector strips 152 may be configured to slide together to form the array of connectors 150, and additional rails 154 may be provided along the edges of the strips 152 to help secure them in place. The antenna array system 100 may also include side panels 180, 182 that may encase, support, and shield the system 100.

One or more of the connector elements 150, connector strips 152, stiffener 130, and antenna array 120 may contain a plurality of sequential (e.g., laminated) metal layers, such as provided by a multilayer build process such as Poly-Strata® multilayer build processing/technology. As such, the connector elements 150, connector strips 152, stiffener 130, and antenna array 120 may each be a unitary monolithic structure comprised of the sequential layers. The layers of the connector 150 (or connector strips 152) may be oriented either perpendicular to, or parallel to, a longitudinal axis of the center conductor(s) 152 of the connector 150 (or connector strips 152). Similarly, layers of the antenna array 120 may be oriented either perpendicular to, or parallel to, a longitudinal axis of the feedthroughs 121 of the antenna array 120.

Figure 4:
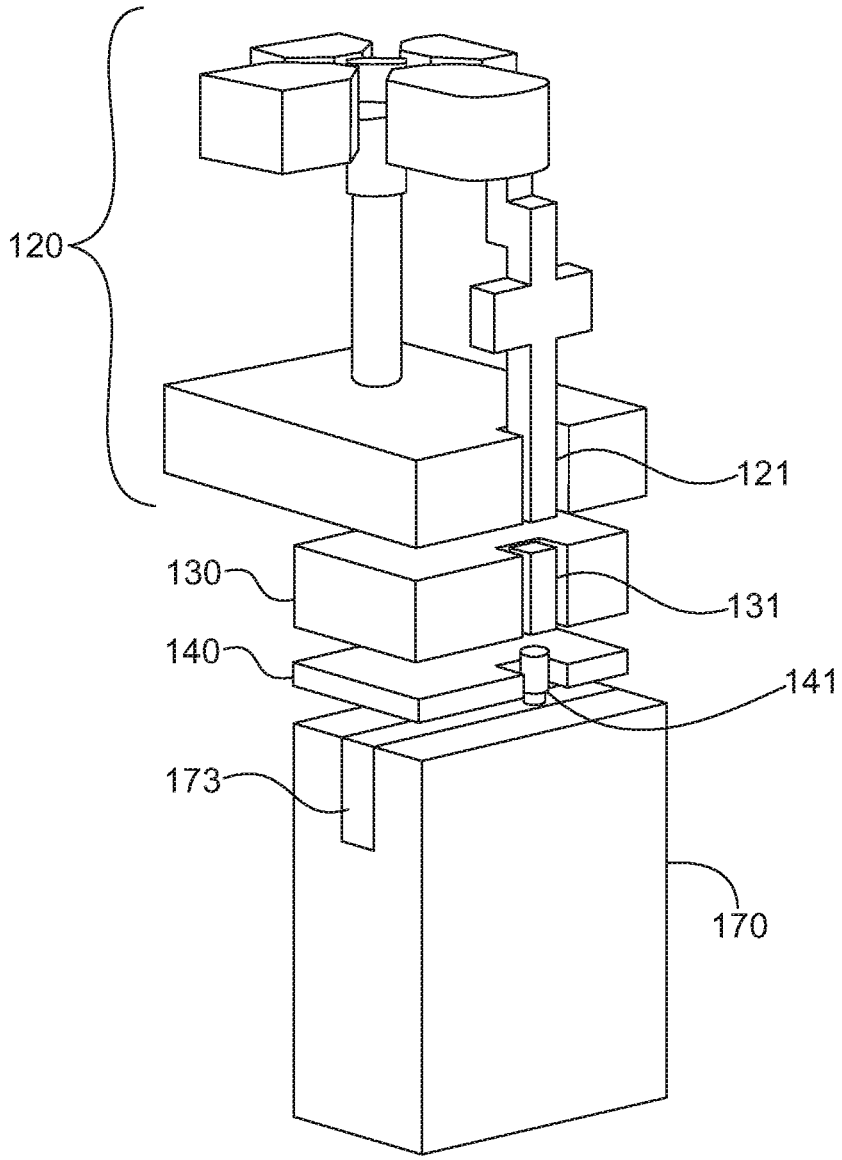
FIG. 4 schematically illustrates a fragmentary exploded isometric view of a further exemplary configuration of a microwave/millimeter-wave component to circuit board connection in accordance with the present invention in which antenna array elements are electrically connected with an edge connected printed circuit board.

FIG. 4 schematically illustrates a further exemplary antenna system in accordance with the present invention, in which components 120, 130, 140, 170 may be removably attached to one another and may use edge metallization 173 of a circuit board 170, which can obviate the need for the connector 150 of FIGS. 1-3. In particular, the antenna array 120 may be electrically connected to the conductive stiffener sheet 130, with the respective feedthroughs 121, 131 of the antenna array 120 and stiffener sheet 130 electrically connected to one another. The pin 141 of the LGA 140 may be electrically connected to the feedthrough 131 of the stiffener sheet 130. The circuit board 170 may differ from that shown in FIG. 3 in that a metallization 173 may be provided on the edge of the circuit board 170, and the metallization 173 may be electrically connected to the pin 141 of the LGA 140, thus completing the electrical circuit between the board 170 and the antenna array 120.

These and other advantages of the present invention will be apparent to those skilled in the art from the foregoing specification. Accordingly, it will be recognized by those skilled in the art that changes or modifications may be made to the above-described embodiments without departing from the broad inventive concepts of the invention. It should therefore be understood that this invention is not limited to the particular embodiments described herein, but is intended to include all changes and modifications that are within the scope and spirit of the invention as set forth in the claims.

What is claimed is:

1. A connector configured to provide physical and electrical connection to a circuit board having conductive traces, the connector comprising:

a mounting feature for receiving an edge of the circuit board; and at least one coaxial waveguide disposed within the connector, the waveguide having a center conductor having a first end, the first end configured to be electrically connected to a conductive trace of the circuit board, wherein all side surfaces of the center conductor are ground shielded.

2. The connector of claim 1, wherein the connector comprises a plurality of sequential layers of a metal joined to provide a unitary monolithic structure.

3. The connector of claim 2, wherein the center conductor has a longitudinal axis and the plurality of layers are disposed perpendicular to the longitudinal axis.

4. The connector of claim 2, wherein the center conductor has a longitudinal axis and the plurality of layers are disposed parallel to the longitudinal axis.

5. The connector of claim 2, wherein the at least one coaxial waveguide comprises an air spaced coaxial waveguide.

6. The connector of claim 2, wherein the mounting feature is a slot.

7. The connector of claim 2, wherein the at least one coaxial waveguide comprises a plurality of waveguides.

8. An antenna system, comprising:

an antenna array;

the connector of claim 1, the center conductor thereof electrically connected to the antenna array; and at least one circuit board disposed in the mounting feature, the circuit board electrically connected to the center conductor of the connector to provide electrical connection between the circuit board and the antenna array.

9. The antenna system of claim 8, wherein the antenna array is removably attached to the connector.

10. The antenna system of claim 8, wherein the antenna array comprises a plurality of sequential layers of a metal joined to provide a unitary monolithic structure.

11. The antenna system of claim 8, wherein the antenna array includes a conductive feedthrough, the conductive feedthrough electrically connected to the center conductor of the connector.

12. The antenna system of claim 8, wherein the first end of the center conductor of the connector is electrically connected to a selected electrical trace of the circuit board.

13. The antenna system of claim 8, wherein the first end of the center conductor of the connector is soldered to a selected electrical trace of the circuit board.

14. The antenna system of claim 8, wherein the circuit board comprises electronics for driving the antenna array.

15. The antenna system of claim 8, wherein the center conductor of the connector is electrically connected to the antenna array via a conductive elastomer.

16. The antenna system of claim 8, comprising an LGA electrically connected between the antenna array and the connector.

17. The antenna system of claim 16, wherein the LGA is removably connected to the antenna array.

18. The antenna system of claim 16, wherein the LGA is soldered to the connector.

19. The antenna system of claim 8, wherein the at least one coaxial waveguide of the connector comprises a plurality of coaxial waveguides, and the connector is electrically connected to the antenna array via a grid of conductive elastomer pins disposed between the connector and the antenna array, each pin disposed in electrical connection with a respective center conductor of the plurality of coaxial waveguides.

20. The antenna system of claim 8, wherein the connector is one of a plurality of connectors and the at least one circuit board comprises a plurality of circuit boards.

21. A connectorized circuit board assembly, comprising the connector of claim 1 and a circuit board disposed in the mounting feature, the circuit board electrically connected to the center conductor.

22. The connectorized circuit board assembly of claim 21, wherein the first end of the center conductor of the connector is electrically connected to a selected electrical trace of the circuit board.

23. The connectorized circuit board assembly of claim 21, wherein the first end of the center conductor of the connector is soldered to a selected electrical trace of the circuit board.

24. A method for creating a connector configured to provide physical and electrical connection to a circuit board having conductive traces, comprising:

a. depositing a plurality of layers over a substrate, wherein the layers comprise one or more of conductive, non-conductive and sacrificial materials;

b. patterning the layers of conductive, non-conductive and sacrificial material to define a structure of the connector which includes a mounting feature for receiving an edge of the circuit board, and at least one coaxial waveguide disposed within the connector, the waveguide having a center conductor having a first end, the first end configured to be electrically connected to a conductive trace of the circuit board, wherein all side surfaces of the center conductor are ground shielded; and c. removing the sacrificial material to provide the connector.

25. The method of claim 24, wherein the plurality of layers are disposed parallel to a longitudinal axis of the center conductor.

26. The method of claim 24, wherein the plurality of layers are disposed perpendicular to a longitudinal axis of the center conductor.

27. The method of claim 24, wherein the at least one coaxial waveguide comprises an air spaced coaxial waveguide.

* * * * *